US009509104B2

(12) United States Patent
Wong et al.

(10) Patent No.: US 9,509,104 B2
(45) Date of Patent: Nov. 29, 2016

(54) CONNECTOR ASSEMBLIES AND ELECTRONIC DEVICES WITH THE SAME

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Shih-Chi Wong, New Taipei (TW); Chien-Hung Lee, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/861,072

(22) Filed: Sep. 22, 2015

(65) Prior Publication Data

US 2016/0087381 A1 Mar. 24, 2016

(30) Foreign Application Priority Data

Sep. 24, 2014 (TW) ..... 103133116 A

(51) Int. Cl.
*H01R 13/73* (2006.01)
*H01R 27/02* (2006.01)

(52) U.S. Cl.
CPC ..... *H01R 13/73* (2013.01); *H01R 27/02* (2013.01)

(58) Field of Classification Search
CPC ..... G06F 1/1632; H01R 12/7058; H01R 23/7057; H01R 13/73
USPC ..... 439/638, 639, 172, 652; 361/679.41, 361/679.44, 809
See application file for complete search history.

(56) References Cited

U.S. PATENT DOCUMENTS

| | | | | |
|---|---|---|---|---|
| 7,066,767 | B2 * | 6/2006 | Liao | H01R 27/02 439/13 |
| 7,540,748 | B2 * | 6/2009 | Tracy | G06F 1/1616 439/131 |
| 8,672,692 | B2 | 3/2014 | Chun et al. | |
| 9,007,169 | B2 * | 4/2015 | Lee | G06F 1/1632 320/111 |
| 9,164,538 | B2 * | 10/2015 | Moscovitch | F16M 11/04 |
| 2004/0190238 | A1 * | 9/2004 | Hubbard | F16M 11/00 361/679.09 |
| 2009/0316355 | A1 * | 12/2009 | Jones | G06F 1/1632 361/679.55 |
| 2010/0096525 | A1 * | 4/2010 | Yu | F16M 11/10 248/229.2 |

(Continued)

FOREIGN PATENT DOCUMENTS

| | | |
|---|---|---|
| TW | M246863 | 10/2004 |
| TW | M264709 | 5/2005 |
| TW | 201351796 A | 12/2013 |

*Primary Examiner* — Tulsidas C Patel
*Assistant Examiner* — Marcus Harcum
(74) *Attorney, Agent, or Firm* — Zhigang Ma

(57) ABSTRACT

A connector assembly is electrically coupled to an electronic device. The connector assembly includes a supporting assembly supporting the electronic device, an adjusting frame, and a connecting element. The adjusting frame is slidably fixed on the supporting assembly. The connecting element is slidably fixed on the adjusting frame and electrically coupled to the electronic device. The connecting element includes a connector and a cable electrically coupled to the connector. The connector includes a plurality of plugs in different sizes and types. When the electronic device is fixed on the supporting assembly, the adjusting frame is slid to the supporting assembly and the connector is rotated to choose one of the plugs to be coupled to the electronic device.

9 Claims, 5 Drawing Sheets

(56) References Cited

U.S. PATENT DOCUMENTS

2011/0170252 A1* 7/2011 Jones ..... G06F 1/1632
361/679.09
2011/0216483 A1* 9/2011 Vesely ..... B60N 3/004
361/679.01
2011/0223802 A1* 9/2011 Zeller ..... B60R 16/027
439/529
2013/0217448 A1* 8/2013 Kim ..... H04M 1/0254
455/575.1
2015/0207286 A1* 7/2015 Chen ..... H04M 1/04
439/639

* cited by examiner

CONNECTOR ASSEMBLIES AND ELECTRONIC DEVICES WITH THE SAME

FIELD

The subject matter herein generally relates to connector assemblies of electronic devices.

BACKGROUND

Connector assemblies often have one type of plug. However, electronic devices, such as computers, phones and etc., often have different types of ports. In order to charge the different electronic devices, it is necessary to prepare different connector assemblies to be coupled to the ports of different electronic devices.

BRIEF DESCRIPTION OF THE DRAWINGS

Implementations of the present technology will now be described, by way of example only, with reference to the attached figures, wherein.

DETAILED DESCRIPTION

Figure 1:
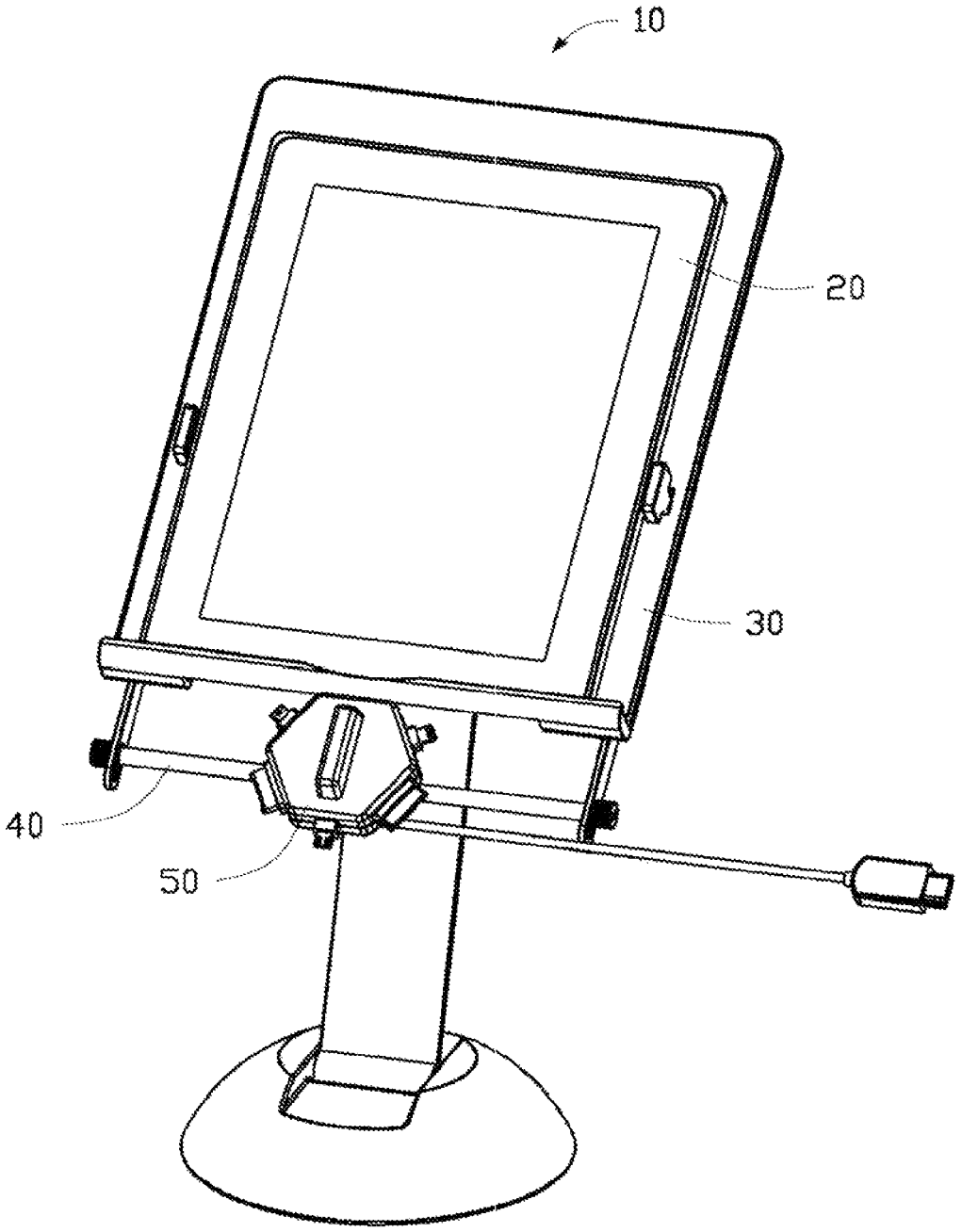
FIG. 1 is a perspective view of an electronic device with a connector assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

The present disclosure is described in relation to a connector assembly and an electronic device with the same.

FIG. 1 illustrates that a connector assembly 10 is electrically coupled to an electronic device 20. In the exemplary embodiment, the electronic device 20 can be a computer, a phone and etc. The electronic device 20 includes an interface (not shown) to be engaged with the connector assembly 10. The connector assembly 10 includes a supporting assembly 30, an adjusting frame 40, and a connecting element 50. The electronic device 20 is supported by the supporting assembly 30. The connecting element 50 is slidably fixed on the adjusting frame 40 to be aligned and coupled with the port (not shown) of the electronic device 20. The adjusting frame 40 is fixed on the supporting assembly 30.

Figure 2:
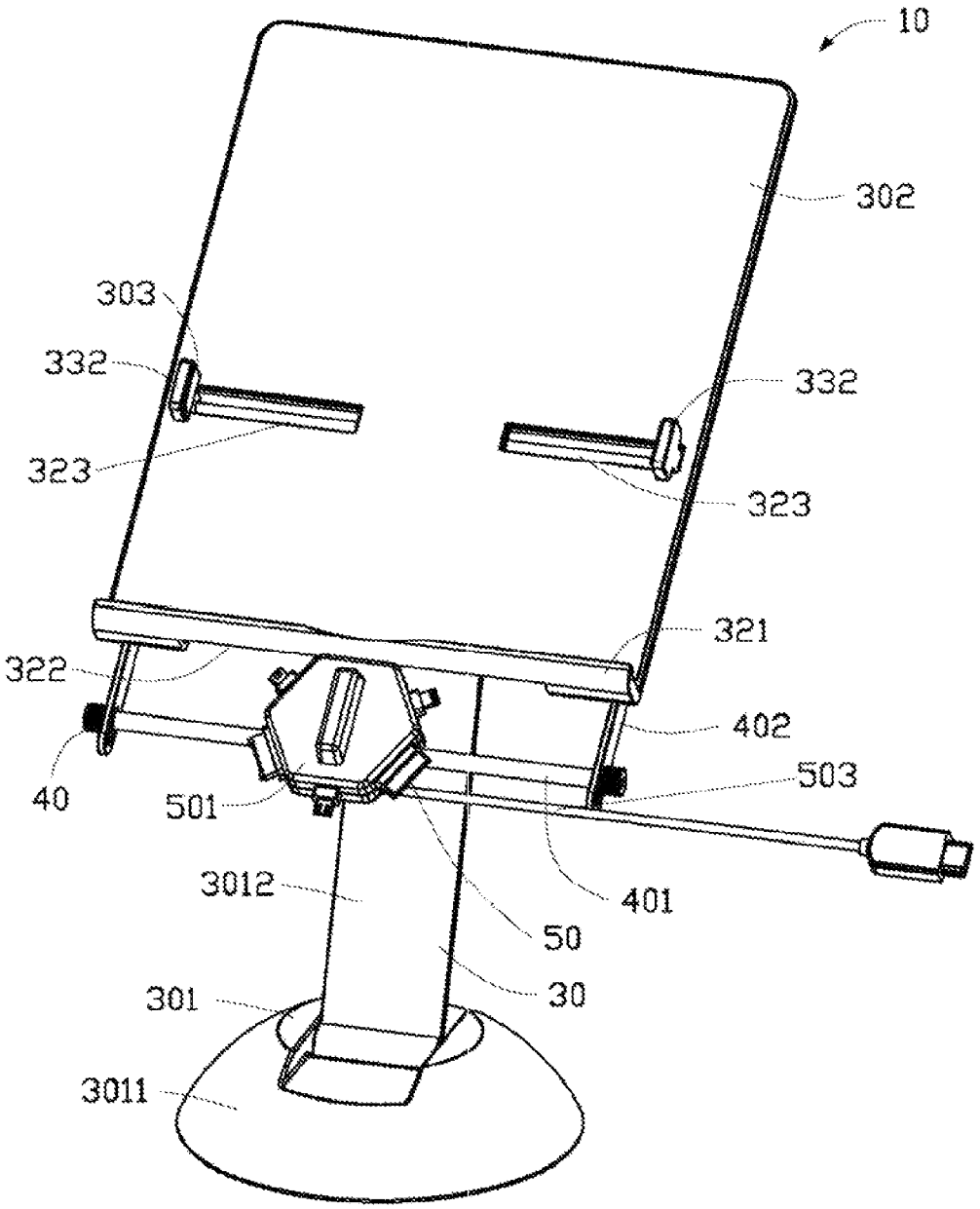
FIG. 2 is a perspective view of the connector assembly of FIG. 1, the connector assembly includes a connector and a connecting sleeve.
Figure 3:
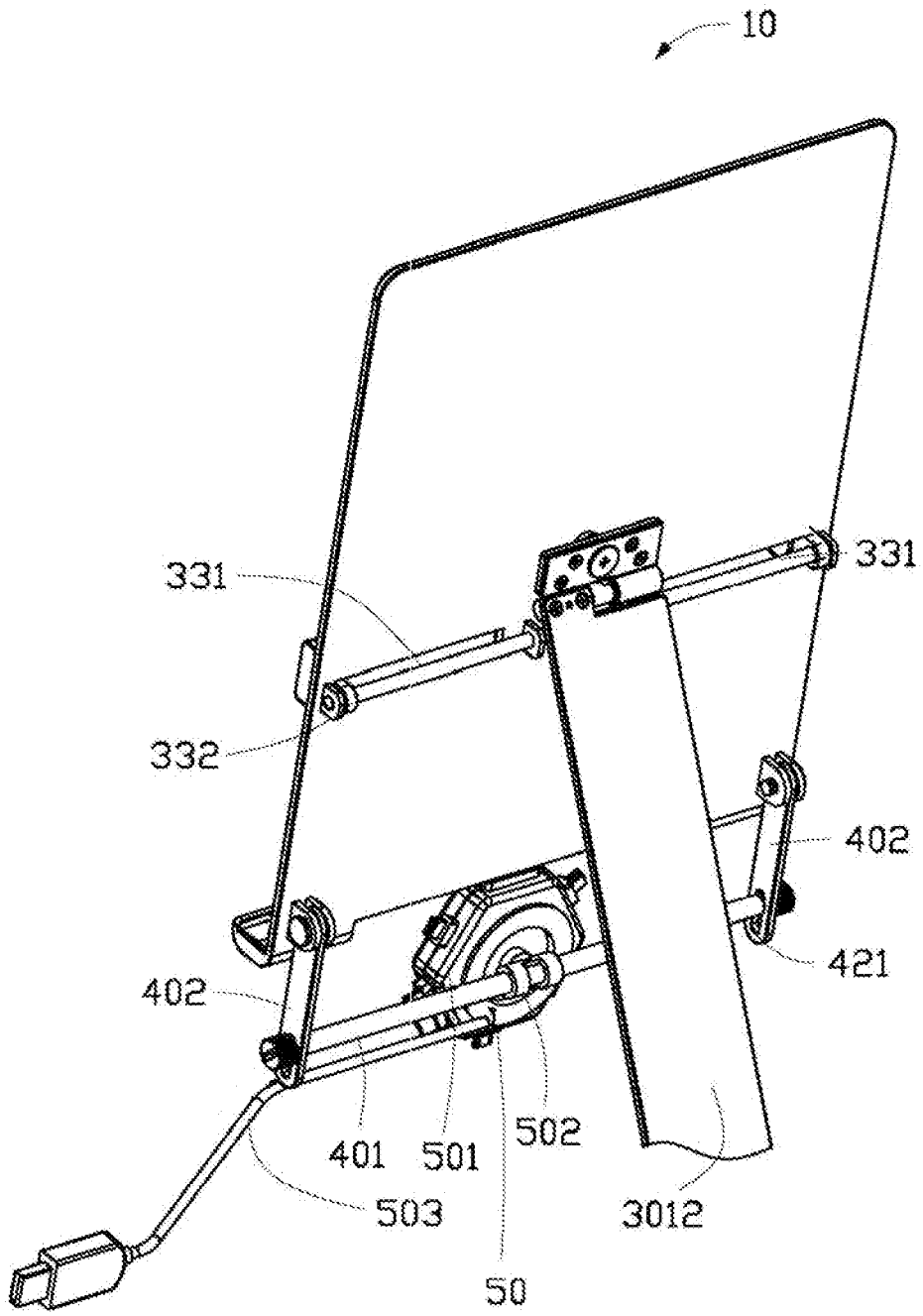
FIG. 3 is a perspective view of the connector assembly of FIG. 2 viewed from another angle.

FIGS. 2-3 illustrate that the supporting assembly 30 includes a base assembly 301, a supporting board 302, and a pair of latching portions 303. The base assembly 301 supports the supporting board 302, and the latching portions 303 are located on the supporting board 302. The electronic device 20 is fixed on the supporting board 302 and located between the pair of latching portions 303, which protects the electronic device 20 from falling from the supporting board 302.

The base assembly 301 includes a base 3011, and a supporting arm 3012 extending from the base 3011. A surface of the base 3011 away from the supporting arm 3012 is located on a horizontal plane, such as a table (not shown).

The supporting board 302 is a rectangle plate. The supporting board 302 is coupled to the supporting arm 3012 in an inclined angel. A projecting edge 321 protrudes from an end of the supporting board 302 facing the base assembly 301. The projecting edge 321 supports the electronic device 20 and protects the electronic device 20 from falling from the supporting assembly 30. The projecting edge 321 defines a groove 322.

A pair of slots 323 are defined on a middle of the supporting board 302. The pair of slots 323 have a distance with each other and parallel with the projecting edge 321. The pair of slots 323 extend from two opposite sides of the supporting board 302 to the middle thereof.

Each of the latching portions 303 slidably engages with the corresponding slot 323. Each of the latching portions 303 includes a guiding rod 331 and a stopper 332. The guiding rod 331 is located on a surface of the supporting board 302 opposite to the electronic device 20. One end of the stopper 332 is sleeved on the guiding rod 331, the other end of the stopper 332 is out of the slot 323. The electronic device 20 is located between the two stoppers 332. The stopper 332 is slid along the slot with respect to the guiding rod 331 by an external force to adjust the distance between the two stoppers 332 according to the size of the electronic device 20.

The adjusting frame 40 is slidably coupled to the supporting board 302 adjacent to the projecting edge 321. The adjusting frame 40 includes a positioning rod 401 and a pair of connecting rods 402. One end of the connecting rod 402 is pivotally coupled (see FIG. 3) to the supporting board 302 and adjacent to the projecting edge 321. The other end of the connecting rod 402 defines sliding slot 421. The positioning rod 401 is fixed between the pair of connecting rods 402. One end of the positioning rod 401 can slid along the sliding slot 421 of one connecting rod 402, and the other end of the positioning rod 401 can slid along the sliding slot 421 of the other connecting rod 402.

The connecting element 50 includes a connector 501, a connecting sleeve 502, and a cable 503. The connecting sleeve 502 is fixed on the positioning rod 401 and coupled to the connector 501. One end of the cable 503 is electrically coupled to the connector 501, and the other end of the cable 503 can be coupled to a connector. In another embodiment, the cable 503 can be coupled to a plurality of connectors.

Figure 4:
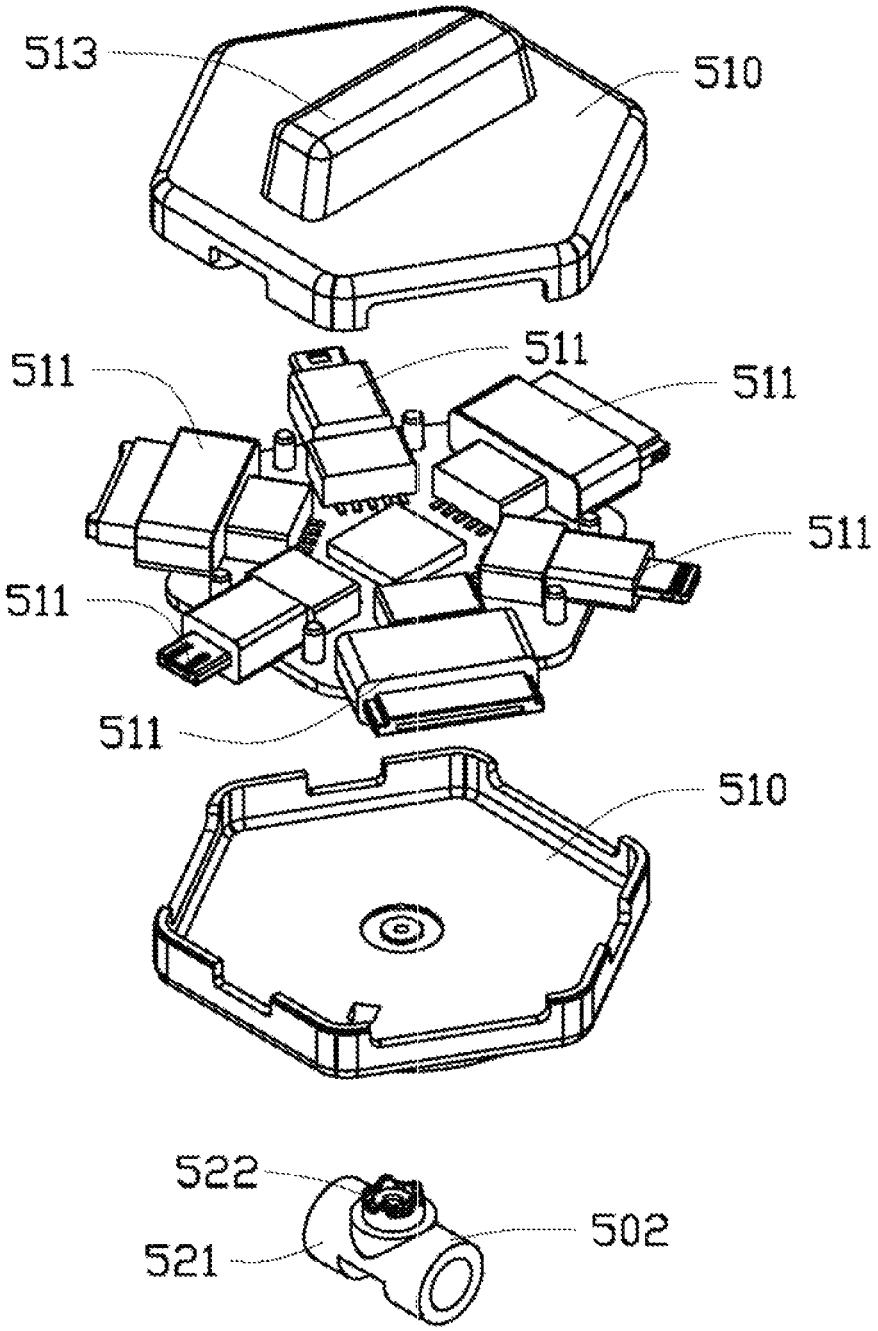
FIG. 4 is an exploded view of the connector and the connecting sleeve of FIG. 2.
Figure 5:
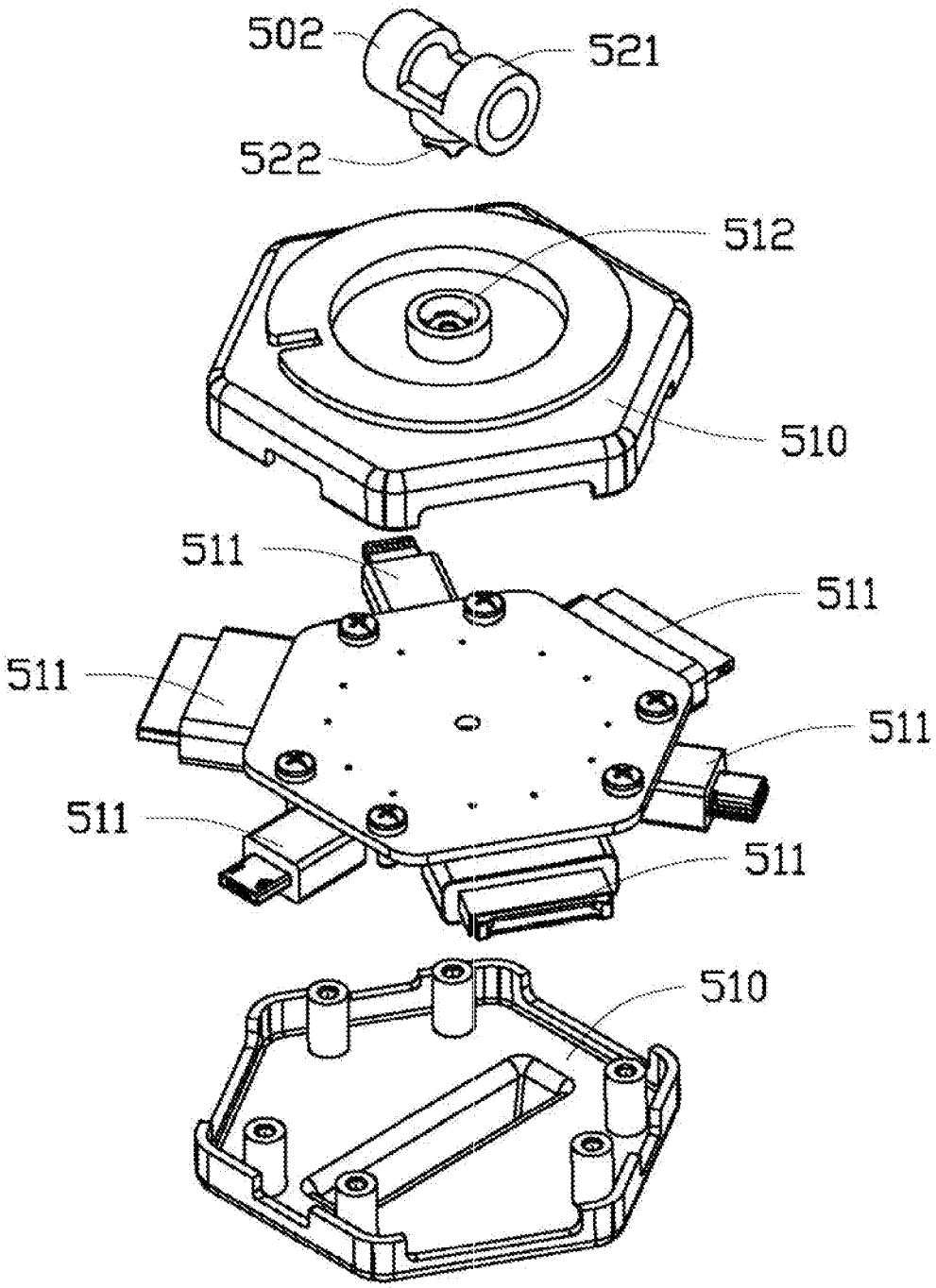
FIG. 5 is an exploded view of the connector and the connecting sleeve of FIG. 4 viewed from another angle.

FIGS. 4-5 illustrate that the connecting sleeve 502 includes a main body 521, and a first connecting portion 522. The main body 521 is a cylinder shape. The main body 521 is slidably fixed on the positioning rod 401, which allows the connecting sleeve 502 to be slid with respect to the positioning rod 401 under an external force. The first connecting portion 522 protrudes from the main body 521.

The connector 501 includes a case 510, and a plurality of plugs 511 in different sizes. The case 510 includes a second connecting portion 512 facing the connecting sleeve 502. The second connecting portion 512 is rotatably coupled to the first connecting portion 522 under the external force, which makes the connector 501 to be rotated with respect to the connecting sleeve 502. The case 510 further includes a rib 513 opposite to the second connecting portion 512. When the rib 513 is rotated by the external force to drive the connector 501 rotate. The plugs 511 are out of the case 510 and electrically coupled to the cable 503. In the exemplary embodiment, the plugs 511 are circularly arranged on the case 510, and the number of the plugs 511 is 8. In other exemplary embodiments, the number of the plugs 511 can be 6 or 9. The type of the plugs 511 can be mini USB (Universal Serial Bus), micro USB, or APPLE™ format.

In use, the latching portions 303 are adjusted according to the electronic device 20 to fix the electronic device 20 on the supporting board 302. The interface of the electronic device 20 is positioned close to the connector 501. The adjusting frame 40 and the connecting sleeve 502 are adjusted to make the connector 501 approach to the interface. According to the size and type of the interface, the rib 513 is rotated to choose a proper plug 511. The plug 511 is inserted into the groove 322 and electrically coupled to the interface, which makes the connector 501 to be electrically coupled to electronic device 20.

In the exemplary embodiment, the connecting element 50 has a plurality of plugs 511 in different sizes and types, and the different sizes and types of the plugs 511 of the connecting element 50 can adapt to the interface of different electronic devices 20.

The exemplary embodiments shown and described above are only examples. Many details are often found in the art such as the other features of a connector assembly and an electronic device with the same. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A connector assembly, for electrically coupled to an electronic device, the connector assembly comprising:

a supporting assembly for supporting the electronic device;

a positioning rod of an adjusting frame slidably fixed on the supporting assembly; and a connecting element slidably fixed on the adjusting frame and electrically coupled to the electronic device, the connecting element comprising a connector and a cable electrically coupled to the connector, the connector comprising a plurality of plugs in different types;

wherein when the electronic device is fixed on the supporting assembly, the positioning rod is slid to the supporting assembly and the connector is rotated to choose one of the plugs to be coupled to the electronic device.

2. The connector assembly of claim 1, wherein the connecting element further comprises a connecting sleeve, the connecting sleeve is slidably located on the adjusting frame, the connector is slidably fixed to the connecting sleeve and rotated with respect to the connecting sleeve under an external force.

3. The connector assembly of claim 2, wherein the connecting sleeve comprises a main body and a first connecting portion, the main body is slidably fixed on the adjusting frame, the first connecting portion protrudes from the main body, the connector comprises a second connecting portion, and the first connecting portion is rotatably coupled to the second connecting portion.

4. The connector assembly of claim 3, wherein the supporting assembly comprises a base assembly, a supporting board supporting the electronic device, and a pair of latching portions, the base assembly supports the supporting board, and the electronic device is fixed on the supporting board and located between the pair of latching portions.

5. The connector assembly of claim 4, wherein a projecting edge protrudes from an end of the supporting board facing the base assembly, and the projecting edge defines a groove.

6. The connector assembly of claim 4, wherein a pair of slots are defined on the supporting board, the pair of slots have are spaced apart from each other, and the pair of slots extend from two opposite sides of the supporting board to the middle thereof.

7. The connector assembly of claim 6, wherein the latching portion comprises a guiding rod and a stopper, the guiding rod is fixed on a surface of the supporting board opposite to the electronic device, one end of the stopper is sleeved on the guiding rod, the other end of the stopper is out of the slot, and the stopper is slid along the slot with respect to the guiding rod by an external force.

8. The connector assembly of claim 4, wherein the adjusting frame comprises a pair of connecting rods, one end of the connecting rod is rotatably coupled to the supporting board, the other end of the connecting rod defines a sliding slot, one end of the positioning rod is slid along the sliding slot of one connecting rod, and the other end of the positioning rod is slid along the sliding slot of the other connecting rod.

9. The connector assembly of claim 8, wherein the connecting sleeve is sleeved on the positioning rod and slid along the positioning rod under an external force.

* * * * *